US006383004B1

(12) United States Patent
Gunay et al.

(10) Patent No.: US 6,383,004 B1
(45) Date of Patent: May 7, 2002

(54) CONNECTION ELEMENT FOR CONNECTING ELECTRICAL LEADS

(75) Inventors: Tarik Gunay, Neuss; Wulf Bramesfeld, Wulfrath; Udo Diedrich, Ennepetal; Reinhard Felgenhauer, Serlohn, all of (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/507,875

(22) Filed: Feb. 22, 2000

(30) Foreign Application Priority Data

Mar. 10, 1999 (DE) ..... 199 10 572

(51) Int. Cl.[7] ..... H01R 9/07
(52) U.S. Cl. ..... 439/329; 439/564
(58) Field of Search ..... 439/562, 564, 439/329, 67, 493, 499

(56) References Cited

U.S. PATENT DOCUMENTS

| | | | |
|---|---|---|---|
| 4,412,714 | A | 11/1983 | Morningstar et al. |
| 4,647,125 | A | 3/1987 | Landi et al. |
| 4,934,946 | A | 6/1990 | Ordway |
| 5,219,303 | A | 6/1993 | Daly et al. |
| 5,730,619 | A | 3/1998 | Hamlin |

FOREIGN PATENT DOCUMENTS

| | | |
|---|---|---|
| DE | 19734872 | 4/1999 |
| EP | 0509380 | 10/1992 |
| EP | 0562340 | 9/1993 |
| GB | 880585 | 10/1961 |
| WO | WO97/37403 | 3/1997 |
| WO | WO97/29526 | 8/1997 |

*Primary Examiner*—Renee Luebke
(74) *Attorney, Agent, or Firm*—Thomas A. Twomey

(57) ABSTRACT

The invention relates to a connection element for the connecting of electrical leads which are provided in particular for motor vehicles and which comprise a plurality of parallel individual conductors which are connected to a common strip-like carrier, comprising an upper part and a lower part, each of which having at least one clamping surface. The clamping surfaces face one another in such a manner that in the connected state, two overlapping leads with mutually facing contact regions are clamped in between the clamping surfaces. The invention further relates to a method for the replacement of electrical components which are in particular provided for motor vehicles with the help of a connection element in accordance with the invention.

15 Claims, 4 Drawing Sheets

CONNECTION ELEMENT FOR CONNECTING ELECTRICAL LEADS

TECHNICAL FIELD

The invention relates to a connection element for the connecting of electrical leads which are provided in particular for motor vehicles and which in each case comprise a plurality of parallel individual conductors which are connected to a common strip-like carrier.

BACKGROUND OF THE INVENTION

For the connecting of leads of this kind, which are present for example in the form of flexible printed circuits (FPCs), in which the individual conductors are arranged between two material layers which serve among other things as insulation, it is known to solder the individual conductors of the leads to be connected to one another or to rivet the leads to one another. Connections of this kind can be released again only with difficulty or with damage to the leads. In addition, the production of connections of this kind is complicated and is either not possible or possible only with considerable cost and complexity in conditions of restricted space such as for example present when installing and replacing electrical components in motor vehicles. Furthermore, the replacement of, for example, defective components is problematical with the known connections as a result of their poor releasability.

SUMMARY OF THE INVENTION

The problem (object) on which the invention is based is to create a possibility of connecting leads of the initially named kind by means of which a good and enduring electrical contact between the respective individual conductors can be achieved in a simple and economical manner, and in which in particular the connection can be released again with as little cost and complexity as possible.

This object is satisfied by an upper part and a lower part which have in each case at least one clamping surface and which with the clamping surfaces facing one another can be put together in such a manner that in the connected state two overlapping leads with mutually facing contact regions are clamped in between the clamping surfaces.

In accordance with the invention the electrical contacts between the respective individual conductors are produced through clamping in of the leads which lie one above the other in an overlap region between the upper part and the lower part of the connection element. The invention enables the bare ends of the leads to be connected to one another, with the insulation or a material layer respectively, in each case being removed region-wise at the lead ends in the case of the initially mentioned FPCs for the preparation of the contact regions comprising the exposed end sections of the individual conductors. In this way the lead ends need not be provided with special connector elements, so that the invention makes possible an electrical connection without connector elements. In addition no soldering processes or other laborious measures are required since in accordance with the invention the electrical connection is achieved in a purely mechanical way through the exertion of a clamping force. In this way a simple and economical possibility for the connection of strip-like electrical leads is provided with parallel individual conductors, in particular of FPCs.

An advantage of the connection element in accordance with the invention consists in that in accordance with a preferred embodiment it can be designed in such a manner that the upper part and the lower part can be releasably connected, in particular latched, to one another.

In this way the electrical connection between the leads can be simply produced by clipping the upper part and the lower part together, with the upper part and the lower part being designed in dependence on the thickness of the lines to be connected in such a manner that in the latched state a sufficiently large clamping force is exerted on the lines in the overlap region. Through releasing of the latch connection, the original state can be restored, i.e. both the production and the cancellation of the electrical connection between the two lines takes place without damage to the lines. Therefore, the lines are available for further electrical connections by means of a connection element in accordance with the invention. Since damage to the lines is avoided in accordance with the invention, it is not necessary to cut away damaged sections of the lines which are unusable for the production of electrical connections.

In accordance with a further preferred exemplary embodiment of the invention the upper part and the lower part are designed to be identical and at least substantially constructionally alike.

Through this a considerable simplification and cost saving in the mass production and stocking of the connection element in accordance with the invention are achieved. In addition the production of the electrical connections is facilitated since a user need not take care to use two different and fitting components for each connection.

In accordance with a further preferred embodiment of the invention the clamping surface of the upper part and/or lower part comprises a plurality of individual clamping surfaces which are formed at preferably elastically deformable webs which in the connected state extend in the longitudinal direction of the individual conductors and which are preferably uniformly spaced in the transverse direction, in particular in dependence on the arrangement of the individual conductors of the leads to be connected.

Through this the clamping force can be applied intentionally to the regions of the carrier of the leads which are provided with the individual conductors. Through the provision of elastically deformable webs an ideal transfer of the clamping force to the leads is provided for. Preferably a small number of individual conductors and preferably exactly one individual conductor is associated with each individual clamping surface. Possible irregularities in the leads can be compensated in this way, thereby ensuring a good and enduring electrical connection between the two leads in the region of each individual conductor.

In accordance with a further preferred exemplary embodiment of the invention the webs have preferably approximately in the middle of their longitudinal extent a protrusion which is preferably bent approximately in U-shape and at the apex region of which at least one individual clamping surface is formed. The clamping force which is transmitted by means of the webs is thus in each case concentrated onto an approximately point-like location, whereby a particularly reliable connection between the leads can be produced.

In accordance with a further preferred embodiment of the invention the leads can be fixed at the upper part and/or lower part in a predetermined relative position.

In this way the lines can be pre-fixed at the upper part and lower part prior to the assembly of the connection element, whereby it is ensured that in the assembly of the connection element the leads are aligned correctly relative to one another and the individual conductors which are to be contacted lie exactly opposite each other as desired in each case.

In accordance with a further preferred embodiment, connection sections of the upper part and the lower part are in each case formed as combined latch/plug sections and in particular for the production of at least one plug connection through the leads and at least one latch connection outside the leads.

In this way the connection sections serve both for the connecting of the upper part and the lower part as well as for fixing of the lines. This multiple function of the connection sections permits the production of good and enduring electrical connections between the lines with a simply constructed connection element.

In accordance with a further preferred embodiment of the invention the clamping surface of the upper part and/or lower part is formed at an insert preferably of metal which is provided as a separate component and which can be fixed in a reception part which preferably consists of plastic.

This two-piece design of the connection element in accordance with the invention enables constructionally alike reception parts to be combined with different inserts so that for different leads, which differ from one another in particular with respect to the number, the separation and/or the width of their individual conductors, only a suitable insert is required and the entire connection element need not be replaced.

In accordance with a further preferred embodiment of the invention, in the connected state at least one ring-shaped seal, which surrounds the contact regions of the leads, is arranged between the upper part and the lower part. The seal can be arranged in a groove-shaped depression of the upper part or of the lower part respectively and—in a two-piece design of the parts—braced at a reception part or an insert.

The contact regions of the leads are protected by the seal against external influences, in particular against moisture, so that the connection element in accordance with the invention can also be used at regions, e.g. at the doors, of a motor vehicle at which moisture must be anticipated.

The object of the invention also relates to a method for the replacement of electrical components which are in particular provided for motor vehicles, and which are connected to electrical leads which comprise a plurality of parallel individual conductors being connected to a common carrier, in which an existing lead, at which the component to be replaced is connected, is severed at a point, and a lead which is to be connected to the component to be hooked up, is connected to the existing lead at the severing point by means of a connection element in accordance with the invention.

Through this an advantageous repair method is created in particular for electrical systems having a plurality of electrical components provided in motor vehicles, the electrical components being connected via a common strip-like lead to a distributor—in connection with components provided at a vehicle door for example to a door coupling—via which the individual components can be connected to a power supply and to a central control unit. In accordance with the invention a defective component can be replaced simply in that the lead section leading to the relevant component and comprising the corresponding number of individual conductors is cut through at any desired well accessible point—for example at predetermined, so-called repair windows. Then the new component, which is already connected to a corresponding lead section having the required length, is connected with the help of a connection element executed in accordance with the invention, to the free end of the existing lead which has arisen at the severing point. Through this a replacement of electrical components can take place in principle as often as desired in each case in a simple way and in the shortest time.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
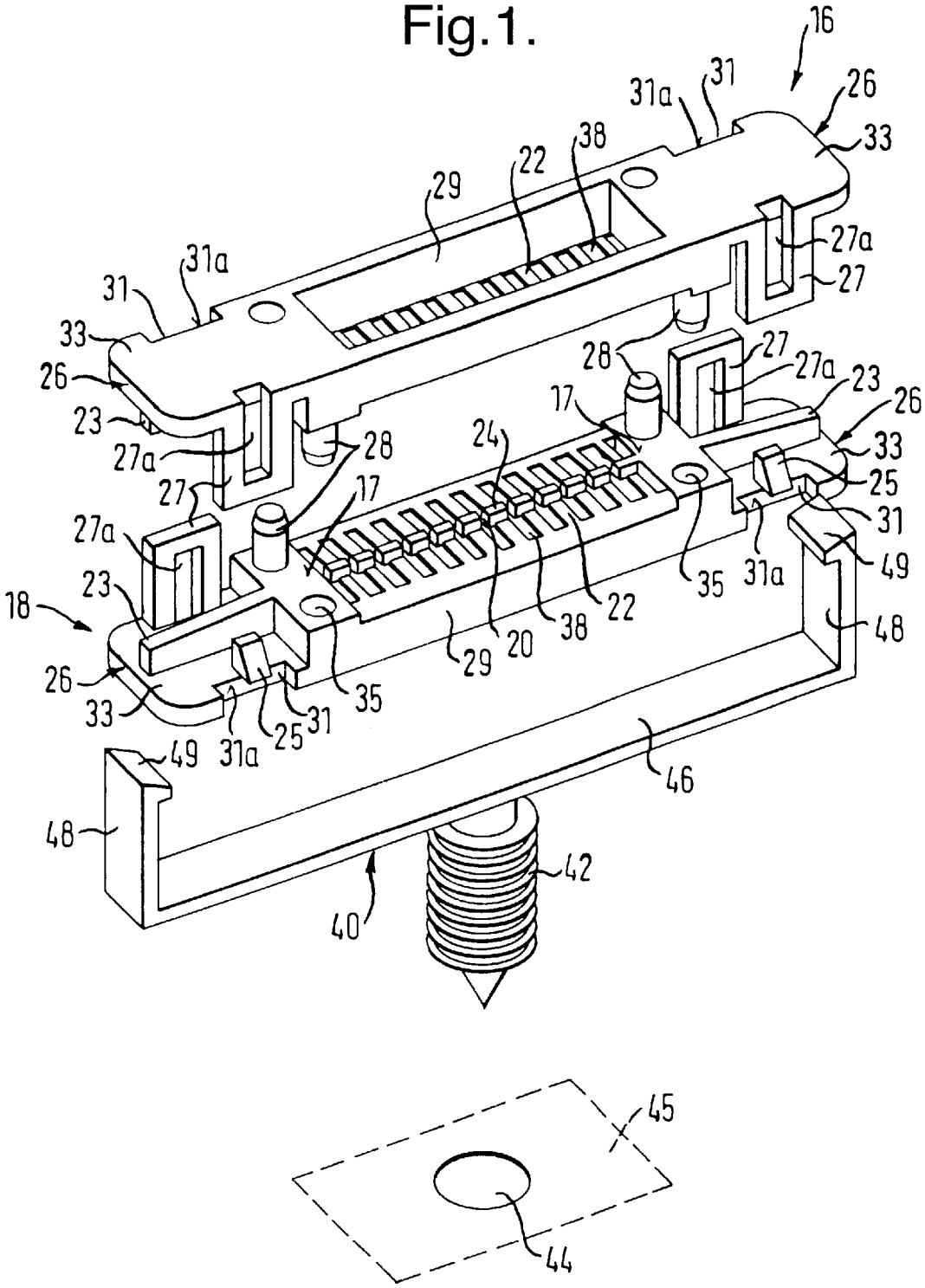
FIG. 1 is a perspective view of a connection element in accordance with an embodiment of the invention.

The connection element in accordance with FIG. 1 comprises an upper part 16 and a lower part 18 which are each manufactured of plastic in a single piece. The upper part 16 and the lower part 18 are identically structured and each comprise a clamping section 29 with a rectangular cross-section which is arranged between two connection sections 26. Each connection section 26 comprises a latch nose 25, a bow-like locking section 27 which bounds a rectangular recess 27*a*, a pin-like plug section 28 and a cylindrical depression 35, the inner diameter of which corresponding to the outer diameter of the plug section 28. The pins 28 of the one part 16, 18 thus fit exactly into the depressions 35 of the other part 16, 18. The latch noses 25 and depressions 35 on the one hand and the locking sections 27 and pins 28 on the other hand are arranged on opposite sides of a longitudinal axis of the respective part 16, 18. In regard to the connection sections 26 the parts 16, 18 are thus constructed asymmetrically with respect to their longitudinal axis.

The latch noses 25 and locking sections 27 project from lateral base plates 33 which have a lesser thickness than the clamping section 29. The pins 28 and depressions 35 are formed on an abutment surface 17 which is elevated relative to the base plates 33. A strip 23 which is formed on each base plate 33 and which extends parallel to the longitudinal axis of the respective part 16, 18 increases the stiffness of the respective part 16, 18 in the connection sections 26.

In the region of the latch noses 25 the base plates 33 are provided with a rectangular cut-out 31, with the latch noses 25 projecting in each case beyond a receding region 31*a*. The width of the cut-outs 31 corresponds to the width of the bow-like locking sections 27, whereas the width of the latch noses 25 corresponds to the width of the recesses 27*a* of the locking sections 27.

It can be seen in particular at the upper part 16 that the clamping section 29 is designed in the shape of a trough and is provided with slits 38 in the base region which extend perpendicular to the longitudinal axis of the respective part 16, 18. A large number of elastically deformable webs 22 are defined by the transverse slits 38 and are provided in each case with a protrusion 24 in the middle of their longitudinal extent, as can be seen at the lower part 18. An individual clamping surface 20 is formed at the apex region of the protrusions 24, at which the webs 22 are in each case flattened which can however also be convexly curved, all individual clamping surfaces 20 together forming a strip-like clamping surface of the respective part 16, 18 which is interrupted by the slits 38. The individual clamping surfaces 20 which are formed on the webs 22 lie higher than the abutment surfaces 17.

The webs 22 are straight, but can however also be convexly curved or angled off in such a manner that the individual clamping surfaces 20 or protrusions 24 respectively lie on a line interrupted by the slits 38, in the manner of a roof ridge. At their ends the webs 22 merge into rounded off edges 39 of the side walls of the clamping section 29.

As is seen in FIG. 1, the upper part 16 and the lower part 18 can be clipped together with mutually facing clamping surfaces 20 in such a manner that the latch noses 25 engage latchingly behind the locking sections 27 in the cut-outs 31 and the pins 28 being plugged into the depressions 35.

The upper part 16 and the lower part 18 are, in particular in regard to the height difference between the abutment surfaces 17 and the individual clamping surfaces 20 as well as to the elastic deformability of the webs 22, structured in such a manner that a clamping force of the respective desired strength is exerted on electrical lines which are arranged between the clamping surfaces 20 and which are not illustrated in FIG. 1.

In the assembled state the upper part 16 and the lower part 18 can be latched with a holder element 40 which is formed as a latch reception in the shape of a U having elastically deformable latch arms 48 which form U-limbs, at the free ends of which inwardly pointing latch noses 49 are provided. The length of the latch arms 48 is dimensioned in such a manner that the assembled connection element and the holder element 40 can be clipped together, with the latch noses 49 latchingly engaging behind the rear sides of the base plates 33 of the respective parts 16, 18.

Projecting from a web section 46 which connects the latch arms 48 to one another, is a pin-shaped securing section 42 which is sharpened at its free end, and is provided with a rippled surface with which the holder element 40 together with the latched in connection element 16, 18 can be anchored in a schematically indicated lead laying opening 44 which is formed e.g. in a body or lining element 45 of a non-illustrated motor vehicle.

Figure 2:
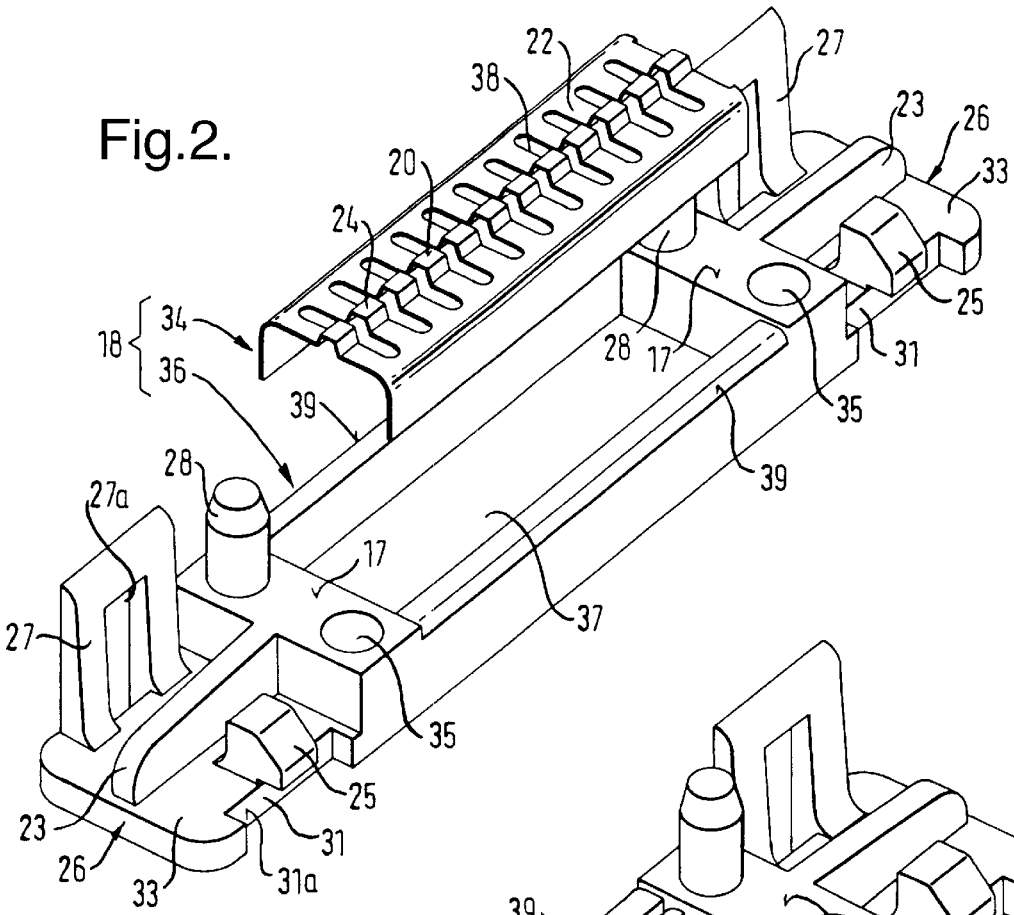
FIG. 2 is a part of a connection element in accordance with a further embodiment of the invention comprising an insert and a reception part.

FIG. 2 shows a part of the connection elecment in accordance with the invention which is designated in the following as lower part 18 and which comprises a reception part 36 and an insert 34. The reception part 36 consists of plastic, whereas the insert 34 is manufactured of metal.

In regard to the connection sections 26 the reception part 36 corresponds to the parts 16, 18 described with reference to FIG. 1. For the reception of the insert 34 the reception part 36 is provided with a recess 37 of rectangular cross-section. The insert 34 can be inserted, e.g. clamped in, into the recess 37 in a manner which prevents falling out. Positioning and/or holder elements which are not illustrated in FIG. 2 can be formed at the reception part 36 to provide for the correct position or for holding, respectively, of the insert 34 in the reception part 36 and which prevent the insert 34 from being pressed out of the recess 37 on the other side of the lower part 18.

The insert 34 is formed as a U-section with a transversely slit base, with the webs 22 defined by the transverse slits 38 having a protrusion 24 with a flattened apex region which forms an individual clamping surface 20. The surface which is formed by all individual clamping surfaces 20 together is thus a narrow strip which is interrupted by the slits 38 and which extends in a plane which is spaced from a plane defined by the lower side of the U-shaped insert 34.

Figure 3:
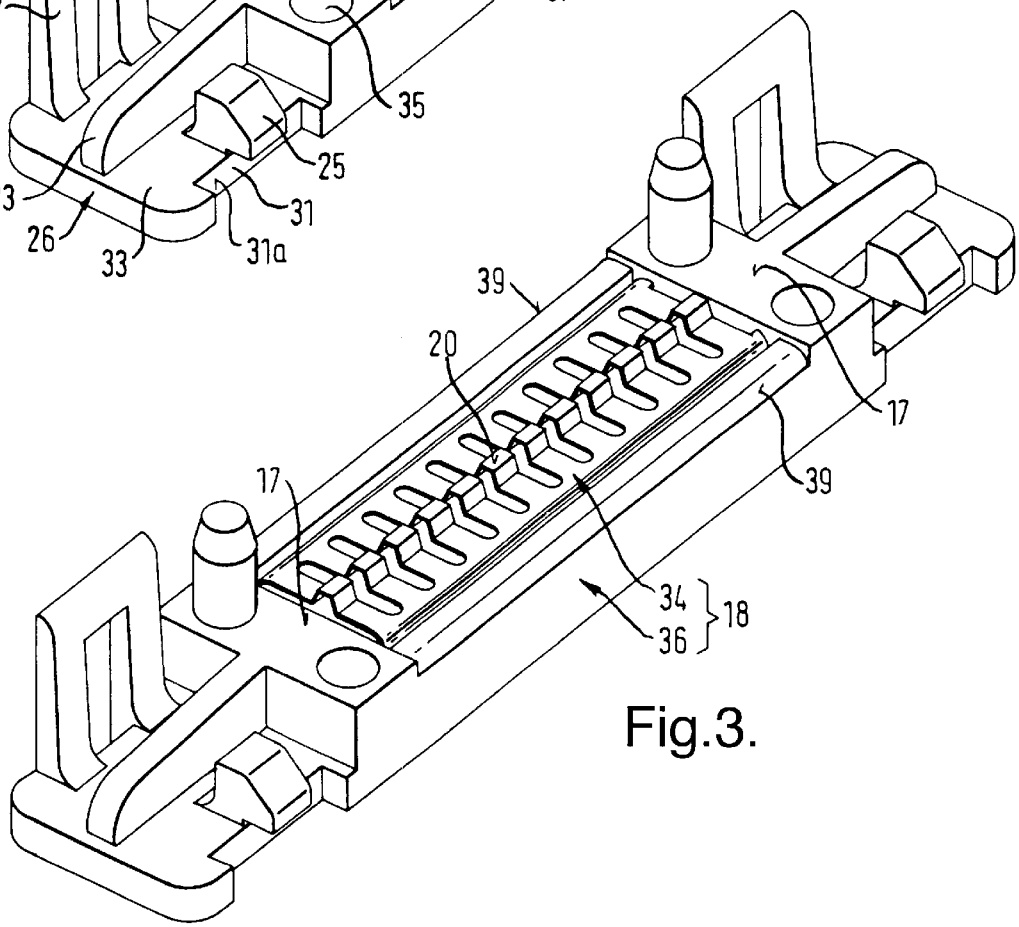
FIG. 3 is the part of FIG. 2 in the assembled state.

FIG. 3 shows the lower part 18 of the connection element in accordance with the invention, which comprises the insert 34 and the reception part 36, in the assembled state. It can in particular be seen that the individual clamping surfaces 20 lie higher than the abutment surfaces 17 and that the edges 39 of the side walls which bound the recess 37 are rounded off.

Figure 4:
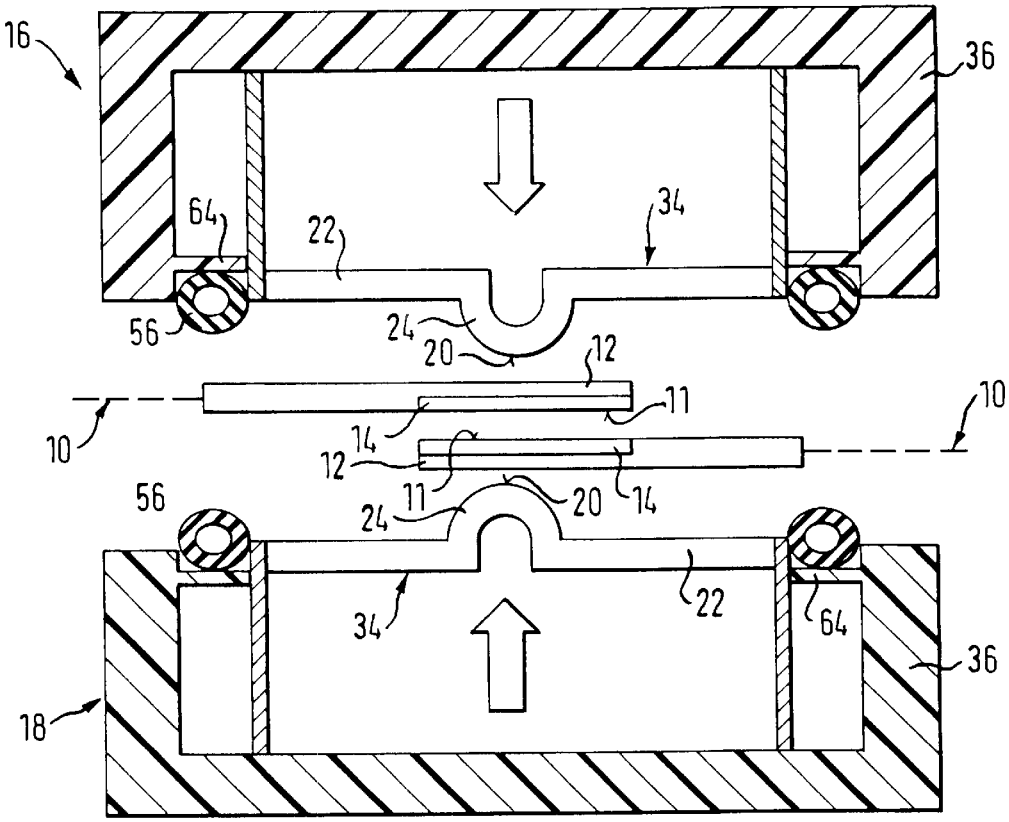
FIG. 4 is a schematic sectional view of a connection element in accordance with a further embodiment of the invention.

In FIG. 4 reception parts 36, manufactured of plastic, of an upper part 16 and lower part 18, and inserts 34 consisting of metal are schematically illustrated. At the webs 22 of the inserts 34 a protrusion 24 is bent into U-shape, the apex region of which forming an individual clamping surface 20 of the respective part 16, 18. The inserts 34 are braced at the base of the reception part 36 and are arranged laterally with an exact fit between a circumferential projection 64 of the reception part 36.

FIG. 4 shows furthermore the free ends of two leads 10 which comprise a strip-like flexible carrier 12 which is provided with a plurality of parallel individual conductors 14, the end sections of which being exposed and in each case forming a contact region 11 of the lead 10. The free ends of the leads 10 are overlappingly arranged between the upper part 16 and the lower part 18 with mutually facing contact regions 11 so that by assembling of the connection element—indicated in FIG. 4 by the arrows—the leads 10 are clamped in between the clamping surfaces 20 of the inserts 34 in the overlap region and are pressed with their individual conductors 14 against one another to produce a good electrical contact between the individual conductors 14 of the leads 10.

A circumferential, approximately rectangular ring seal 56 which is manufactured of rubber is arranged in a groove-shaped depression which is bounded by the insert 34 and by the reception part 36 and the base of which is formed by the projection 64. In the assembled state the space which contains the contact regions 11 of the leads 10 is sealed against the outside by the two seals 56 which are pressed against one another so that the contact regions 11 are protected against external influences, in particular against moisture. In particular in dependence on the clamping force to be exerted, the projections 64 which serve for the support of the seals 56 can also be in each case designed in a single piece with the insert 34 consisting of metal.

Figure 5:
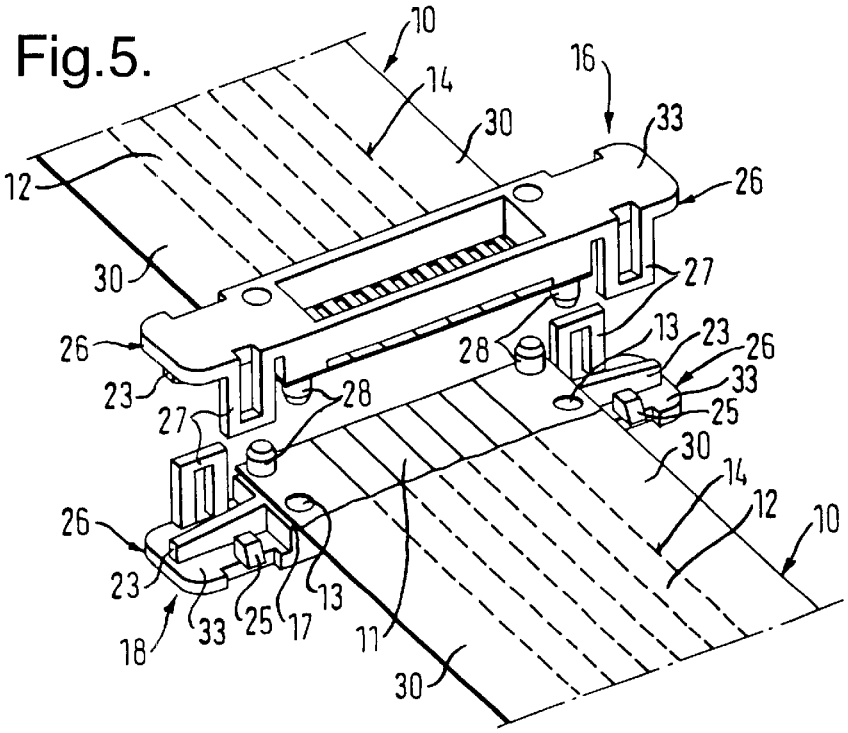
FIG. 5 is a connection element in accordance with the invention with pre-fixed lines.

FIG. 5 shows a pre-assembly state with leads 10 which are prefixed at the upper part 16 and the lower part 18. Each carrier 12, which has for example two layers, is provided between the layers with individual conductors 14 which extend parallel to one another and which are for example printed on a layer in the form of conductor paths. The leads 10 thus represent strip-like flexible printed circuits (FPCs).

In FIG. 5 some of the conductor paths or individual conductors 14 respectively are indicated by parallel broken lines. In principle any desired number of individual conductors 14 can be provided. At the lead 10 which is associated with the lower part 18 it can be seen that the end sections of the individual conductors 14 are exposed, thereby forming the contact region 11 of the respective lead 10. This is indicated in FIG. 5 by means of solid lines. The leads 10 are oriented with their contact regions 11 facing one another.

The leads 10 are provided with edge regions 30 which are free of individual conductors and which serve for the fixing of the leads 10 at the upper part 16 and lower part 18 respectively. For this, positioning holes 13 are formed in the edge regions 30 through which the pin-like plug sections 28 of the parts 16, 18 can be plugged during the assembly of the connection element. In this way the lead 10 is aligned with the respective part 16, 18, and at the same time the lead 10 is secured thereto.

In order to use the full width of the carrier 12 for conductor paths or individual conductors 14 respectively, lugs can alternatively be provided which are formed at the side edges of the carriers 12, in which positioning holes for the pins 28 are formed. The leads can be formed with pairs, formed at regular spacings, of positioning holes 13 formed in the edge regions 30 or in the above mentioned lugs respectively, in order to enable position fixing at parts 16, 18 of a connection element in accordance with the invention, even after severing of a lead 10. The distance between the positioning holes 13 of each pair corresponds to the distance between the pin 28 and the depression 35 of a connection section 26.

FIG. 5 shows in addition that the leads 10 lie in contact with their edge regions 30 on the abutment surfaces 17 from which the pins 28 project and in which the depressions 35 are formed. The edge regions 30 of the leads 10 are thus clamped in between the abutment surfaces 17 in the assembled state, whereas the regions of the carriers 12 which are provided with the individual conductors 14 are clamped in between the clamping surfaces 10 of the two parts 16, 18.

The latching of the parts 16, 18 takes place via the base plates 33 which lie to the sides of the leads 10 and at which the latch noses 25, the locking sections 27 and the strips 23 are formed.

Figure 6:
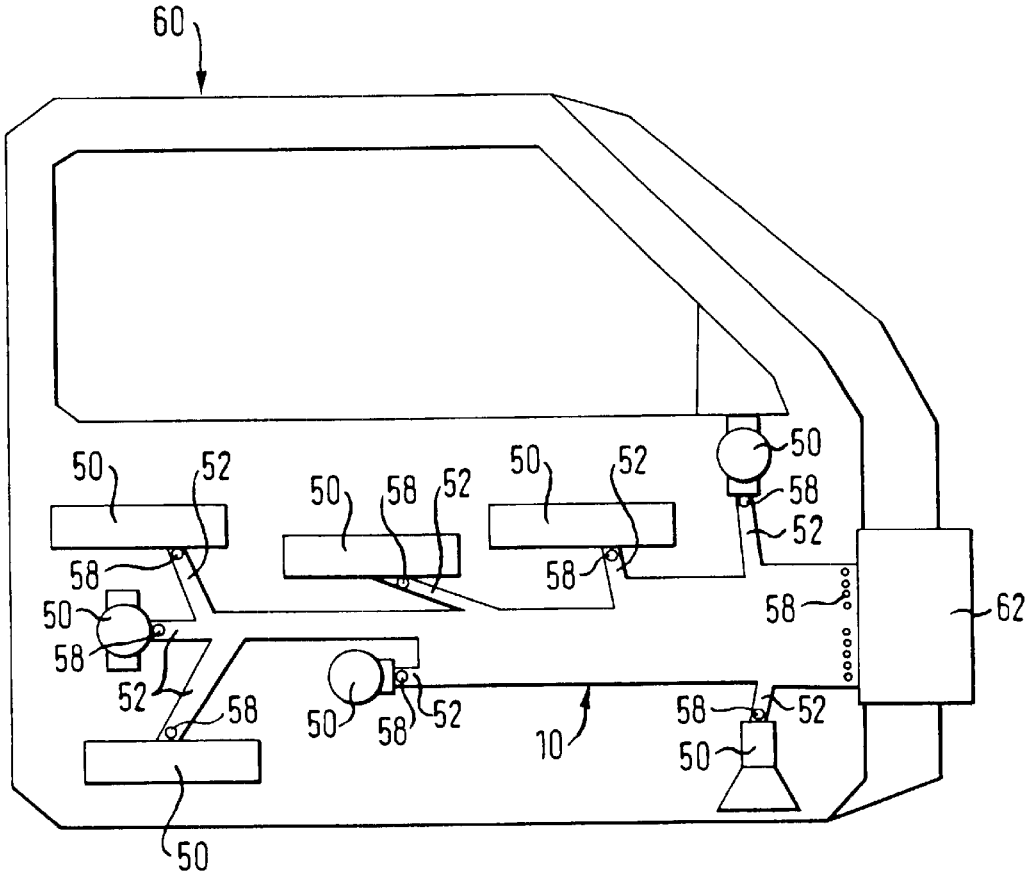
FIG. 6 is a schematic illustration for the explanation of a replacement or repair method in accordance with the invention.

FIG. 6 shows a vehicle door 60 in which numerous electrical components 50 are accommodated. These comprise for example a door lock, a central locking, lighting units, window winders, airbags, outside mirrors, loudspeakers and operating units for the individual components or their electrical motors respectively. The individual components 50 are connected via a single electrical lead 10 which is in the form of a FPC, to a distributor 62 which is provided in the form of a door coupling. The components 50 can be connected via the distributor 62 to a power supply or to a central control unit, respectively, when the door 60 is mounted at a non-illustrated motor vehicle. The components 50 are in each case connected to branching off lead sections or strands 52 of the lead 10, via which in each case at least one of the individual conductors of the lead 10, which is not illustrated in FIG. 6, is led to the respective component 50.

Repair locations 58, which are indicated by circles in FIG. 6, are accessible via so-called repair windows in the door or in an inner door lining respectively.

With the above explained connection element in accordance with the invention a replacement of a defective component 50 can take place in a particularly simple manner. For this the respective strand 52 of the lead 10 is cut through at a repair location 58. The defective component 50 can then be removed. Then a replacement component 50, to which a lead having the corresponding number of individual conductors is connected, is mounted. The free ends of the remaining strand 52 and of the lead of the replacement component 50 are—where appropriate after the removal in each case of the insulation or of a material layer respectively for providing the contact regions (—then brought into engagement with an upper part 16 or a lower part 18 respectively, as is for example illustrated in FIG. 5. Through clipping together of the parts 16, 18 an electrical connection is produced between the strand 58 which is fixed at the one part and the lead of the new component which is fixed at the other part.

The connection can be released again manually or by means of a tool in that the latch noses 25 and locking sections 27 are disengaged. In this way the connection between the respective component 50 and the respective strand 52 of the lead 10 which is laid in the door 60 can be released and reestablished as often as desired, for example for further replacement processes.

What is claimed is:

1. A connection element for connecting electrical leads, comprising:

an upper part comprising a first clamping member comprising a plurality of first webs defined by a plurality of first slits formed in said first clamping member, wherein said first webs are elastically deformable and have a raised relief first contact surface;

a lower part comprising a second clamping member comprising a plurality of second webs defined by a plurality of second slits formed in said second clamping member, wherein said second webs are elastically deformable and have a raised relief second contact surface; and a clamping mechanism which selectively clamps said upper part to said lower part, wherein when said upper and lower parts are clamped together by said clamping mechanism each first contact surface is abuttingly superposed a respective second contact surface such that a clamping force is generated therebetween by elastic deformation of said first and second webs.

2. The connection element of claim 1, wherein said upper part further comprises a first abutment surface, wherein said first clamping member is bounded by, and affixed relative to, said first abutment surface, and wherein said raised relief first contact surface of each said first web is raised relative to said first abutment surface; and wherein said lower part further comprises a second abutment surface, wherein said second clamping member is bounded by, and affixed relative to, said second abutment surface, and wherein said raised relief second contact surface of each said second web is raised relative to said second abutment surface.

3. The connection element of claim 2, further comprising an alignment mechanism connected with said upper and lower parts which provides an alignment of said upper part relative to said lower part so that each first contact surface superposes its respective second contact surface.

4. The connection element of claim 3, wherein said first clamping member is integrally connected with said upper part and said second clamping member is integrally connected with said lower part.

5. The connection element of claim 4, wherein said upper and lower parts are identical.

6. The connection element of claim 5, further comprising a seal connected to at least one of said first and second abutment surfaces, wherein when said upper and lower parts are clamped together, a sealed enclosure of said first and second clamping members is thereby formed.

7. The connection element of claim 6, wherein said upper and lower parts each have a first end, an opposite second end, a first side and an opposite second side; wherein said clamping mechanism comprises at each of said upper and lower parts:

a first locking section connected to said first side of said upper part at said first end thereof, said first locking section having a locking recess formed therein;

a first latch nose connected to said second side of said upper part at said first end thereof;

a second locking section connected to said second side of said lower part at said second end thereof, said second locking section having a locking recess formed therein; and a second latch nose connected to said first side of said lower part at said second end thereof;

wherein when said upper and lower parts are clamped together, said first ends of said upper and lower parts are clamped together by said first latch nose of said upper part being received in said locking recess of said first locking section of said lower part and by said first latch nose of said lower part being received in said locking recess of said first locking section of said upper part; and wherein when said upper and lower parts are clamped together, said second ends of said upper and lower parts are clamped together by said second latch nose of said upper part being received in said locking recess of said second locking section of said lower part and by said second latch nose of said lower part being received in said locking recess of said second locking section of said upper part.

8. The connection element of claim 7, wherein said alignment mechanism comprises at each of said upper and lower parts:

a first pin located on said upper part adjacent said second side and adjacent said first end;

a first depression located on said upper part adjacent said first side and adjacent said first end;

a second pin located on said lower part adjacent said first side and adjacent said second end; and a second depression located on said lower part adjacent said second side adjacent said second end;

wherein when said upper and lower parts are clamped together, said first pin of said upper part is alignably received into said first depression of said lower part, and said first pin of said lower part is alignably received into said first depression of said upper part; and wherein when said upper and lower parts are clamped together, said second pin of said upper part is alignably received into said second depression of said lower part, and said second pin of said lower part is alignably received into said second depression of said upper part.

9. The connection element of claim 8, wherein said clamping mechanism comprises a holder element clippably connected to said upper and lower parts, said holder element having a pin-shaped section for being holdably received into an aperture of an article.

10. The connection element of claim 3, wherein said first clamping member is removably connected with said upper part and said second clamping member is removably connected with said lower part.

11. The connection element of claim 10, wherein said upper and lower parts are identical.

12. The connection element of claim 11, further comprising a seal connected to at least one of said first and second abutment surfaces, wherein when said upper and lower parts are clamped together, a sealed enclosure of said first and second clamping members is thereby formed.

13. The connection element of claim 12, wherein said upper and lower parts each have a first end, an opposite second, a first side and an opposite second side; wherein said clamping mechanism comprises at each of said upper and lower parts:

a first locking section connected to said first side of said upper part at said first end thereof, said first locking section having a locking recess formed therein;

a first latch nose connected to said second side of said upper part at said first end thereof;

a second locking section connected to said second side of said lower part at said second end thereof, said second locking section having a locking recess formed therein; and a second latch nose connected to said first side of said lower part at said second end thereof;

wherein when said upper and lower parts are clamped together, said first ends of said upper and lower parts are clamped together by said first latch nose of said upper part being received in said locking recess of said first locking section of said lower part and by said first latch nose of said lower part being received in said locking recess of said first locking section of said upper part; and wherein when said upper and lower parts are clamped together, said second ends of said upper and lower parts are clamped together by said second latch nose of said upper part being received in said locking recess of said second locking section of said lower part and by said second latch nose of said lower part being received in said locking recess of said second locking section of said upper part.

14. The connection element of claim 13, wherein said alignment mechanism comprises at each of said upper and lower parts:

a first pin located on said upper part adjacent said second side and adjacent said first end;

a first depression located on said upper part adjacent said first side and adjacent said first end;

a second pin located on said lower part adjacent said first side and adjacent said second end; and a second depression located on said lower part adjacent said second side adjacent said second end;

wherein when said upper and lower parts are clamped together, said first pin of said upper part is alignably received into said first depression of said lower part, and said first pin of said lower part is alignably received into said first depression of said upper part; and wherein when said upper and lower parts are clamped together, said second pin of said upper part is alignably received into said second depression of said lower part, and said second pin of said lower part is alignably received into said second depression of said upper part.

15. The connection element of claim 14, wherein said clamping mechanism comprises a holder element clippably connected to said upper and lower parts, said holder element having a pin-shaped section for being holdably received into an aperture of an article.

* * * * *